US009565986B2

(12) United States Patent
Fair et al.

(10) Patent No.: US 9,565,986 B2
(45) Date of Patent: Feb. 14, 2017

(54) FLOOR MOP WITH COLLAPSIBLE FLEXIBLE BAG RESERVOIR

(71) Applicant: BONAKEMI USA, INCORPORATED, Aurora, CO (US)

(72) Inventors: Paul Fair, Denver, CO (US); Jamie Kummerfield, Denver, CO (US); Kristi Correll, Aurora, CO (US)

(73) Assignee: BONAKEMI USA, INCORPORATED, Aurora, CO (US)

( * ) Notice: Subject to any disclaimer, the term of this patent is extended or adjusted under 35 U.S.C. 154(b) by 59 days.

(21) Appl. No.: 14/733,624

(22) Filed: Jun. 8, 2015

(65) Prior Publication Data

US 2015/0359401 A1 Dec. 17, 2015

Related U.S. Application Data

(60) Provisional application No. 62/013,161, filed on Jun. 17, 2014, provisional application No. 62/015,211, filed on Jun. 20, 2014, provisional application No. 62/015,202, filed on Jun. 20, 2014, provisional application No. 62/017,953, filed on Jun. 27, 2014, provisional application No. 62/017,946, filed on Jun. 27, 2014, provisional application No. 62/017,659, filed on Jun. 26, 2014.

(51) Int. Cl.
*A47L 13/22* (2006.01)
*A47L 13/256* (2006.01)

(52) U.S. Cl.
CPC ..... *A47L 13/22* (2013.01); *A47L 13/256* (2013.01)

(58) Field of Classification Search
CPC ..... A47L 13/22
USPC ..... 401/14, 137, 138, 139, 152, 153, 157
See application file for complete search history.

(56) References Cited

U.S. PATENT DOCUMENTS

| | | | | |
|---|---|---|---|---|
| 6,505,986 | B1 * | 1/2003 | Oder | A45D 19/02 222/211 |
| 6,663,306 | B2 | 12/2003 | Policicchio et al. | |
| 7,427,169 | B2 * | 9/2008 | Ma | A45D 19/02 132/113 |
| 7,607,192 | B2 | 10/2009 | Flora et al. | |
| 8,152,400 | B2 * | 4/2012 | LaFlamme | A47L 13/17 401/187 |
| 8,807,858 | B2 * | 8/2014 | Fitzpatrick | A47L 13/22 239/754 |
| 2003/0209263 | A1 | 11/2003 | Bell et al. | |
| 2006/0196000 | A1 | 9/2006 | Petner | |
| 2009/0241280 | A1 | 10/2009 | Pho et al. | |

OTHER PUBLICATIONS

International Search Report for PCT/US2015/036047 dated Sep. 24, 2015, 1 page.

* cited by examiner

*Primary Examiner* — David Walczak
*Assistant Examiner* — Joshua Wiljanen
(74) *Attorney, Agent, or Firm* — Klaas, Law, O'Meara & Malkin, P.C.; William P. O'Meara, Esq.

(57) ABSTRACT

A mop assembly including a mop handle and a mop head mountable on the mop handle and a spray head mounted on the mop handle or the mop head and a collapsible flexible bag reservoir filled with liquid that is removably mountable on the mop head or the mop handle and a liquid pump assembly adapted to pump liquid from the collapsible flexible bag reservoir to the spray head.

6 Claims, 14 Drawing Sheets

FLOOR MOP WITH COLLAPSIBLE FLEXIBLE BAG RESERVOIR

This application claims the benefit of the following prior filed U.S. provisional patent applications, which are each hereby incorporated by reference for all that is disclosed therein: U.S. Provisional Application Ser. No. 62/013,161 filed Jun. 17, 2014 for Floor Mop with Liquid Reservoir in Mop Head of Correll, et. al.; U.S. Provisional Application Ser. No. 62/015,211 filed Jun. 20, 2014 for Mop Head Assembly with Debris Catcher of Correll, et al.; U.S. Provisional Application Ser. No. 62/015,202 filed Jun. 20, 2014 for Mop Pad With Stiffening Ring Member of Correll, et al.; U.S. Provisional Application Ser. No. 62/017,953 filed Jun. 27, 2014 for Mop With Flexible Ears of Correll, et al.; and U.S. Provisional Application Ser. No. 62/017,659 filed Jun. 26, 2014 for Floor Mop with Multiple Use Collapsible Flexible Bag of Correll et al. This application also claims priority from U.S. patent application Ser. No. 14/733,658 filed Jun. 8, 2015 for Floor Mop, which is hereby incorporated by reference for all that it discloses.

Many modern floor mops include an elongate handle that is pivotally attached to a mop head. A mop pad made from fabric material is removably attached to the mop head and may be easily removed for cleaning or replacement. More recently, some floor mops had been provided with liquid dispensing systems that allow floor cleaner, floor polish or the like, to be dispensed from the mop as it moves across the floor.

SUMMARY

Disclosed herein is a mop assembly including a mop handle, a mop head mountable on the mop handle, a spray head mounted on the mop handle or the mop head, a collapsible flexible bag reservoir filled with liquid that is removably supportable on the mop head or the mop handle, and a liquid pump assembly adapted to pump the liquid from the collapsible flexible bag reservoir to the spray head.

Also disclosed is method of cleaning including dispensing liquid through a nozzle mounted on a mop assembly from a collapsible flexible bag reservoir supported on the mop assembly.

Also disclosed is a cleaning assembly including a mop handle, a mop head mountable on the mop handle, a spray head mounted on at least one of the mop handle and mop head, a collapsible flexible bag reservoir filled with floor treating liquid that is removably mountable on the mop handle and supported within an enclosure, and a liquid pump assembly adapted to pump the liquid from the collapsible flexible bag reservoir to the spray head.

DETAILED DESCRIPTION

Figure 1:
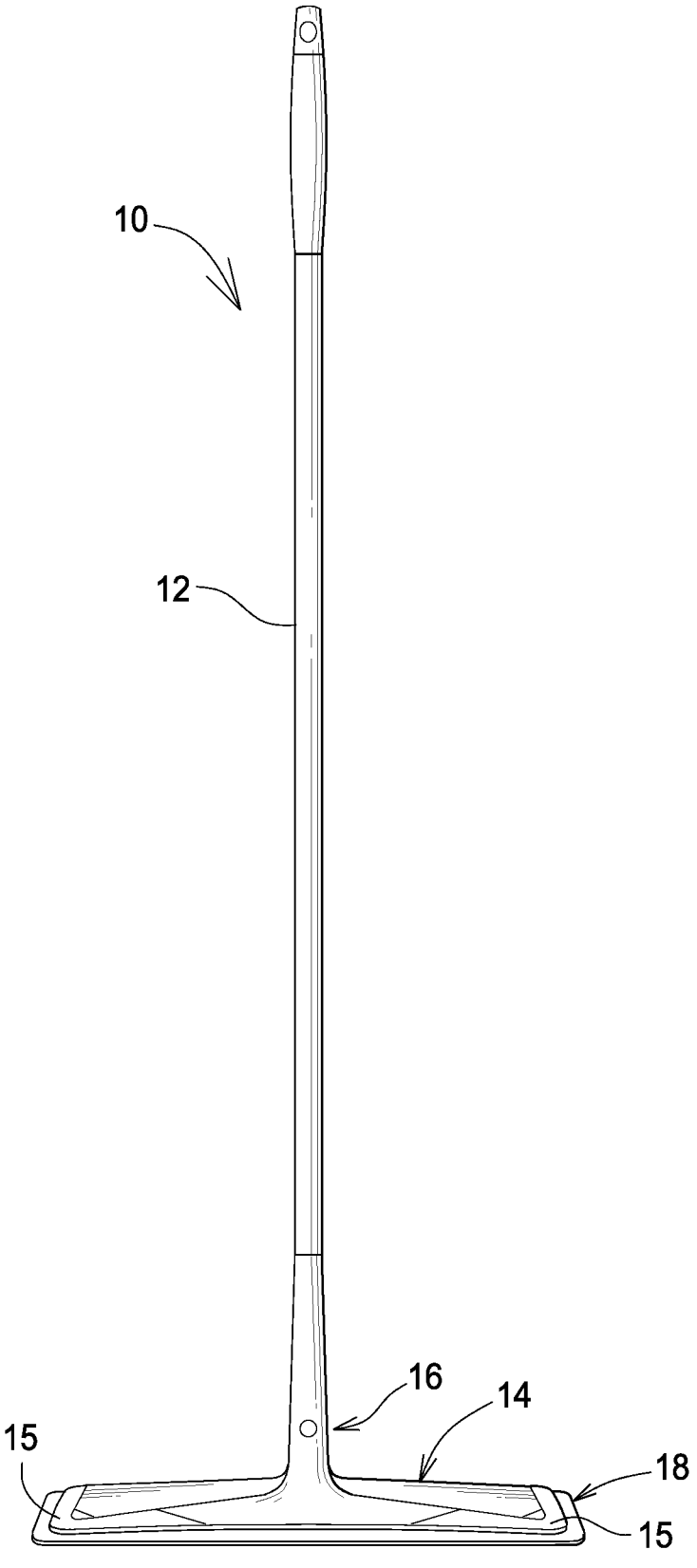
FIG. 1 is an isometric view of a first floor mop.

FIG. 1 illustrates an example mop 10 having an elongate mop handle 12 attached to a mop head 14 that has flexible ear portions 15. The mop head 14 may be attached to the handle 12 by a conventional handle attachment assembly 16. This assembly 16 enables the handle 12 to pivot about both a horizontal and a vertical axis. A mop pad 18 is removably attached to the mop head 14.

Figure 2:
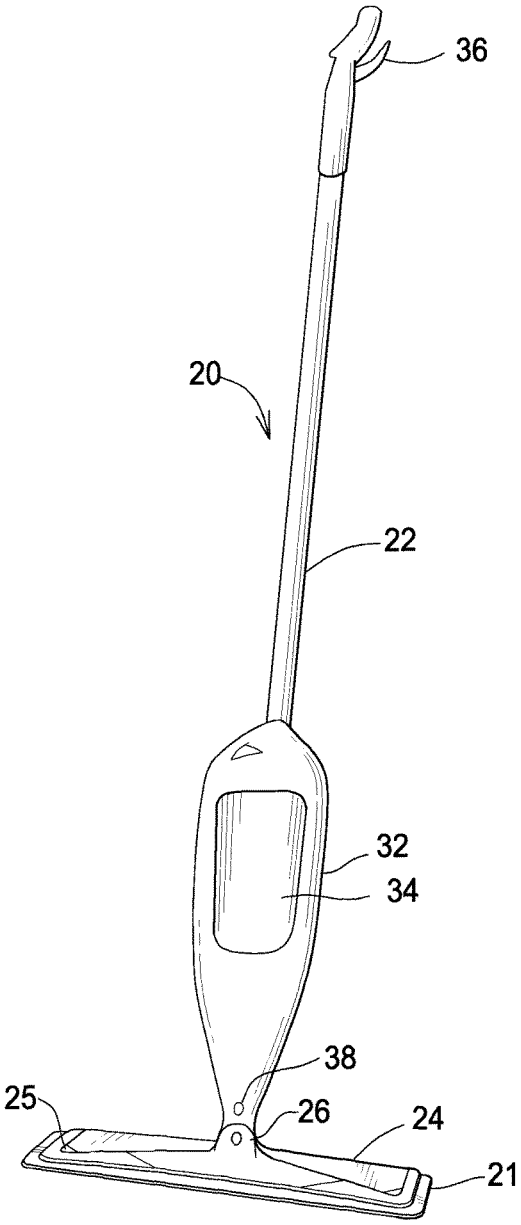
FIG. 2 is an isometric view of a second floor mop.

FIG. 2 illustrates another example floor mop 20. The mop has an elongate handle 22 attached to a mop head 24 by a conventional handle attachment assembly 26. The mop head 24 may have flexible ear portions 25. A mop pad 28 is removably attached to the mop head 24. The elongate handle 22 comprises a reservoir assembly 32 that holds a collapsible flexible bag reservoir 34 filled with liquid, such as floor cleaner or polish. A trigger assembly 36 is provided at the top of the handle for actuating a conventional mechanical pump that causes a mist to be discharged from a spray nozzle 38 located at the lower front portion of the handle 22.

Figure 3:
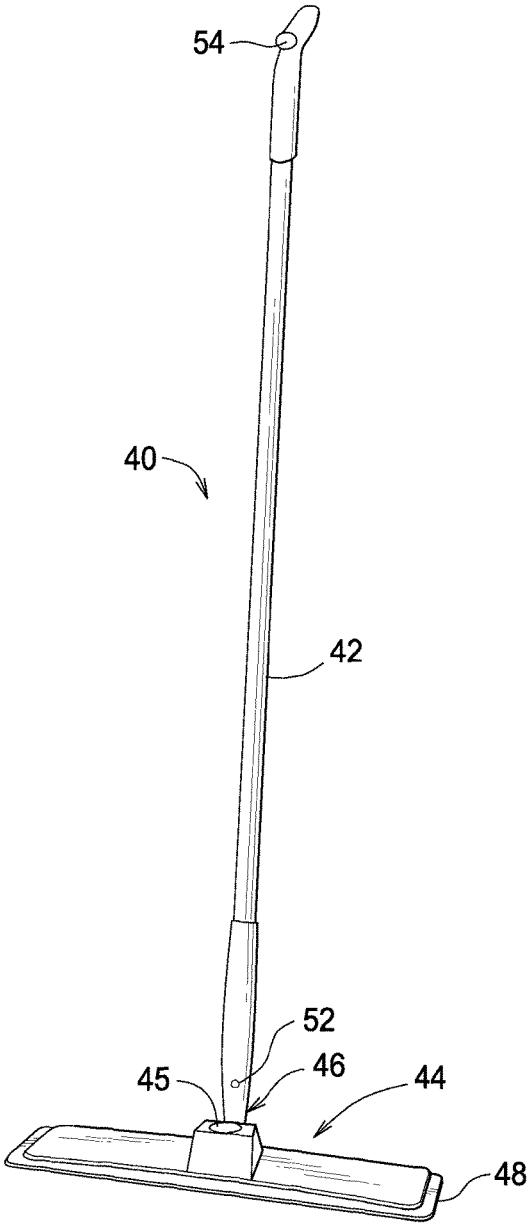
FIG. 3 is an isometric view of a third floor mop.

FIG. 3 illustrates another example floor mop 40. Mop 40 has an elongate handle 42 attached to a mop head 44 by a conventional handle attachment assembly 46. Mop head 44 comprises an internal reservoir filled with floor cleaning or other for treating solution. Access to the interior reservoir is provided through an opening in the top portion of the mop head 44 that is covered by a closure member 45. A mop pad 48 is attached to the mop head 44. A liquid dispensing system provided on the mop comprises a spray nozzle 52 located on the mop handle 42, as shown, or on the mop head 44. The liquid dispensing system also includes an internal pumping assembly driven by an internally mounted electric motor and battery assembly. The electric motor and battery assembly may be mounted in the head 44 or in the mop handle 42. A motor actuator switch or button 54 may be provided at the upper end of the handle 42.

Figure 4:
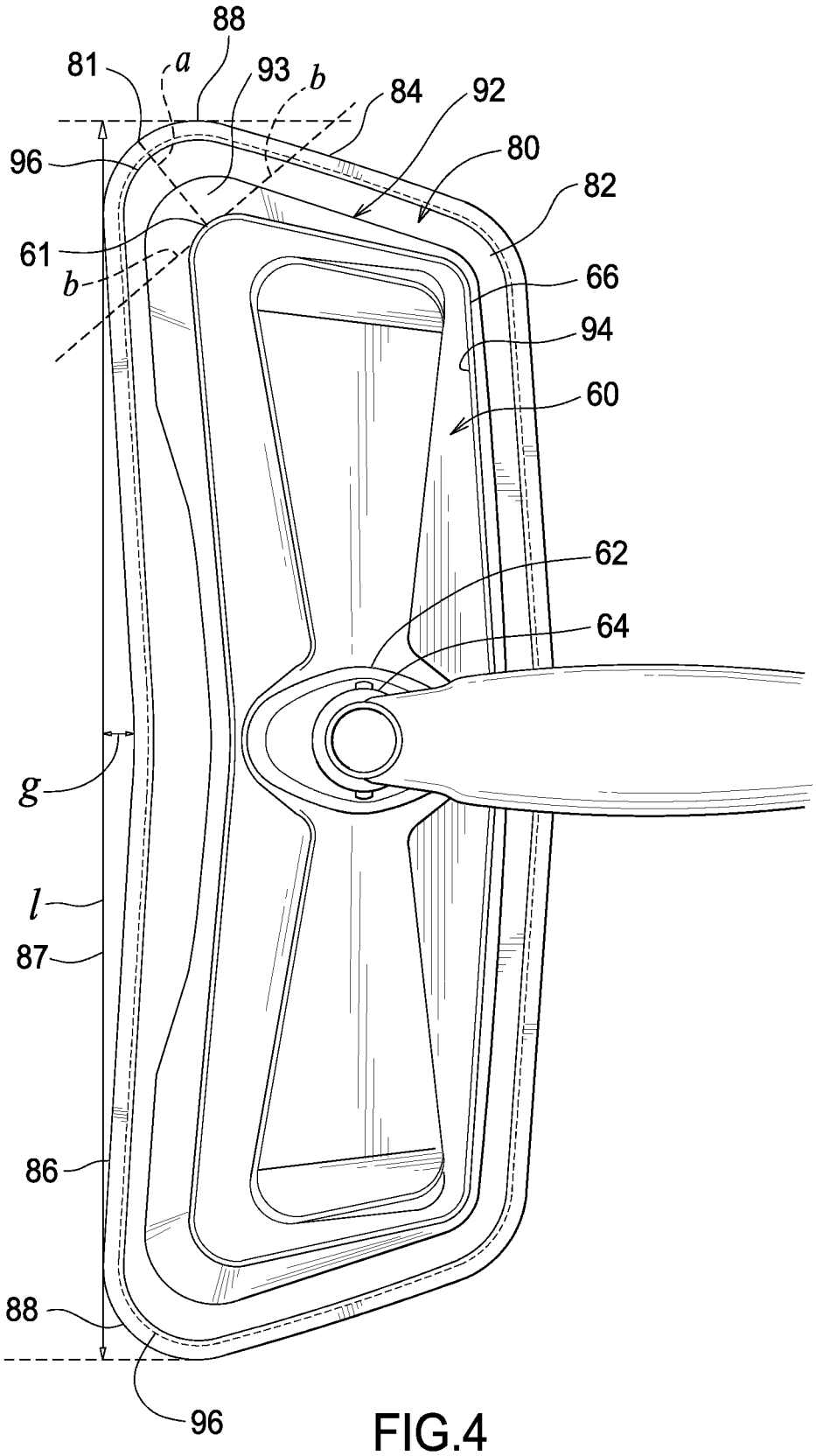
FIG. 4 is a top plan view of a floor mop head and mop pad.

FIG. 4 is a top plan view of a mop head 60 which is constructed from a relatively rigid material such as stiff plastic or the like. The mop head comprises a handle attachment portion 62 which may be a conventional double pivot assembly 64. The mop head has a generally trapezoid shaped periphery 66 with rounded corners.

A mop pad 80 is attached to the mop head 60. The mop pad 80 has a flexible fabric portion 82 with an outer peripheral edge 84. A front portion 86 of the outer peripheral edge 84 has a generally arcuate shape. For example the dimension "I" between the most remote points at the front of the mop pad 80 may be about 18 inches, and the largest gap distance "g" between the front peripheral edge 86 and a cord drawn between the outer corners of the front peripheral edge 86 may be about 0.5 inches. The mop pad 80 has rounded front corners 88. An over molded stiffening ring 92 may be integrally attached to the flexible fabric portion 82 of the mop pad 80. The stiffening ring may be constructed from rubber or a resilient plastic that is sufficiently stiff to help the flexible portion hold its shape and resiliently return to that shape after deformation. However, the stiffening ring is sufficiently flexible to allow bending of the pad when it encounters a fixed object, such as a wall or furniture. This stiffening ring 92 may enable use of a smaller mop head 60 than would be required if the entire mop pad 80 were made from flexible fabric material. The stiffening ring 92 may have an inner periphery 94 conforming to the outer periphery 66 of the mop head 60. The mop pad 80 has two flexible "ear" portions 96 which are located at the outer front corners of the mop pad. These ear portions 96 flex upwardly when the mop head is moved along a wall allowing the mop pad to engage the floor all the way up to the wall, as well as a small portion of the wall, as it is moved across the floor. Once the mop head is moved away from the wall or other object, the ears 96, assisted by the stiffening ring 92, resiliently return to their original flat shape in generally coplanar relationship with the rest of the mop pad 80.

In the embodiment illustrated in FIG. 4 each flexible ear is comprised primarily of an "ear triangle" that has an altitude line "a" extending from an outer edge point 81 at the center of the associated ear portion 88 to the nearest point 61 on the mop head periphery 66. The base "b" of this "ear triangle" is perpendicular to altitude line "a" and extends to the outer edge 84 of the mop pad 80.

Figure 5:
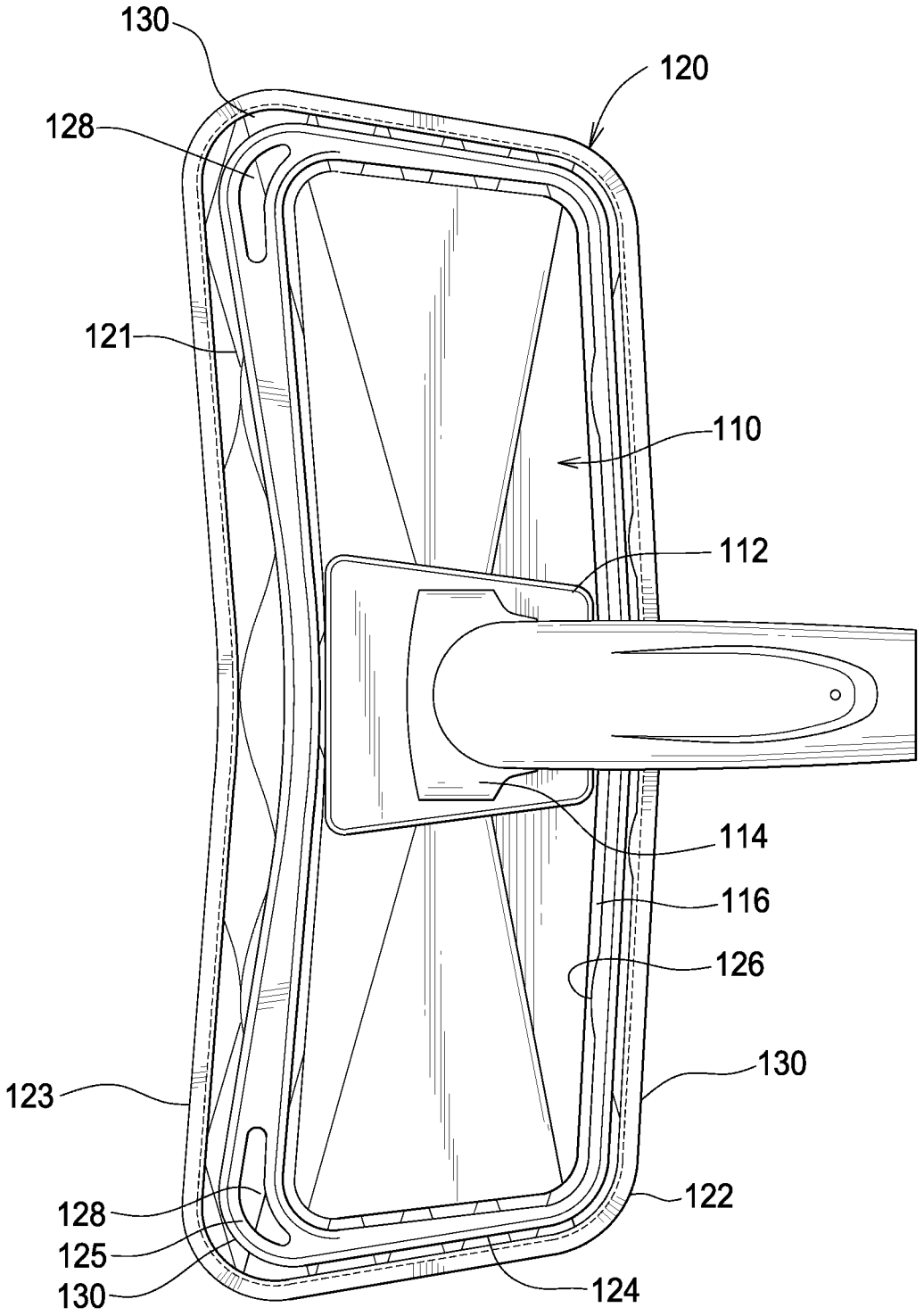
FIG. 5 is a top plan view of another floor mop head and mop pad.

FIG. 5 is a top plan view of a mop head 110, which is similar to the mop head 60. The mop head 110 may have a conventional handle attachment portion 112 including a mop handle pivot assembly 114. The mop head has a peripheral edge 116, which has a generally trapezoid shape with rounded corners.

A mop pad 120 is removably mounted on the mop head 110. The mop pad 120 comprises a flexible portion 121 with an outer peripheral edge 122. The peripheral edge 122 may have the same shape as that described above with respect to mop pad 80, in which the front edge 123 of the mop pad functions as a debris catcher. In the assemblies of both FIGS. 4 and 5, the inwardly concave, arcuate shapes of each mop head and compliment the debris catcher function of the mop pad. Because the front edge of the mop head is generally the same shape as that of the mop pad it may be positioned relatively nearer to the front edge of the mop pad along its entire arcuate shape and thus better stiffens and supports the mop pad.

The mop pad 120 may have a 3-D printed stiffening ring 124 formed from plastic. The stiffening ring 124 has an inner periphery 126 conforming generally to the outer periphery 116 of the mop head 110. An arcuate slot 128 may be provided in the ring 124 at corner portions 125. These slotted corner portions of the stiffening ring 124 and the adjacent portions of the mop pad flexible material portion 121 form the resilient ears 130.

Figure 7:
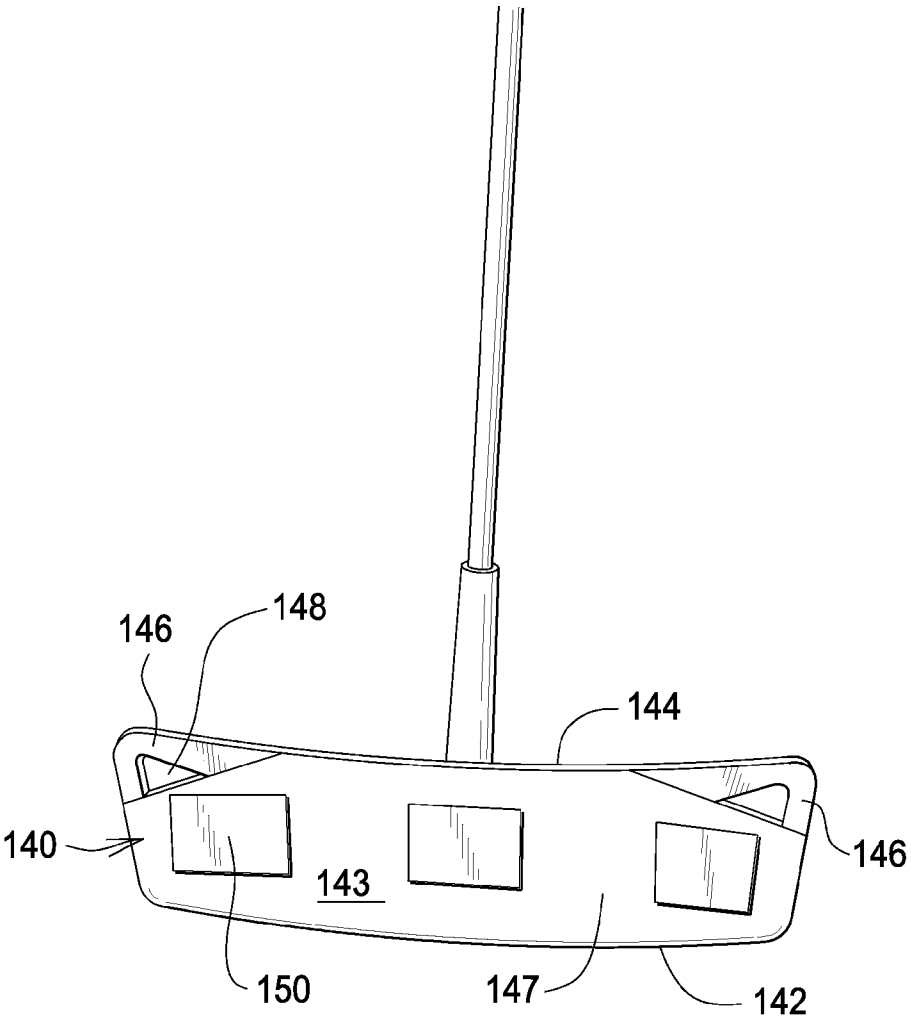
FIG. 7 is a bottom isometric view of the floor mop head and attached handle of FIG. 6.
Figure 6:
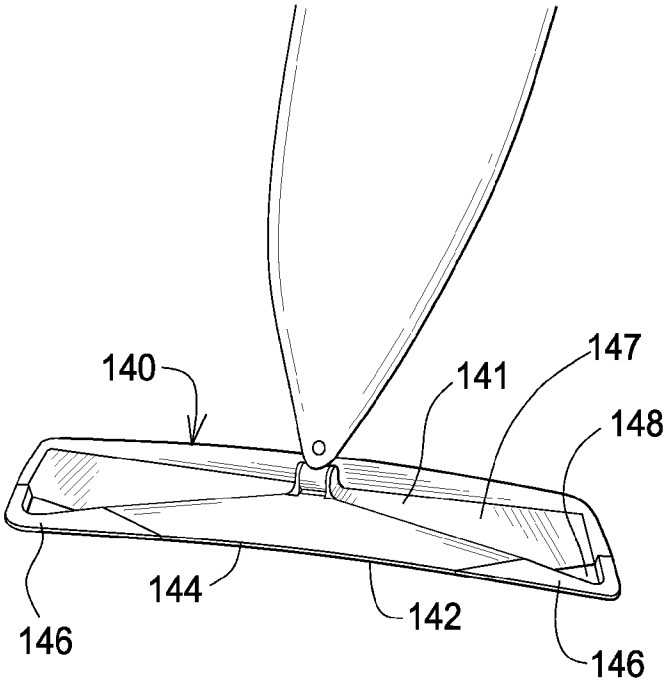
FIG. 6 is a frontal isometric of a floor mop head and attached handle.

FIGS. 6 and 7 illustrate a mop head 140 which may be formed entirely from relatively stiff plastic. The mop head 140 has a generally trapezoidal shape with a top surface portion 141, a bottom surface portion 143 and an outer periphery 142. The outer periphery has a front edge 144, which may be arcuate and inwardly concave and adapted to support a mop pad (not shown) of that is slightly larger and of that same general shape. The mop head 140 may have relatively flexible front ear portions 146 to facilitate flexing of the mop head and attached mop pad when the mop encounters an object near a lateral end of the mop head 140. The ear portions 146 may be separate, generally L-shaped, flexible members attached to a stiffer main body member 147 of the mop head 140. In another embodiment, relatively flexible ear portions are provided in a single piece, integrally formed mop head by cutting holes 148 in the mop head to form each ear portion.

As best illustrated by FIG. 7, a plurality of attachment strips 150, which each comprise a first portion of a hook and loop fastener system, such as Velcro®, are attached, as by adhesive, to the bottom portion 143 of the mop head 140. Corresponding fastener strips (not shown) are attached to the top surface of an associated mop pad, which may be the same as or similar to the other mop pads disclosed herein.

Figure 8:
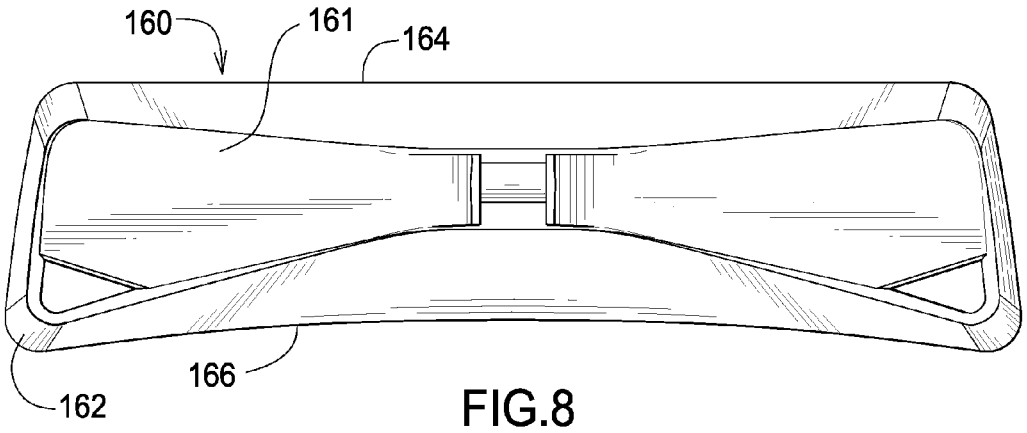
FIG. 8 is a top isometric view of a floor mop head having an inwardly concave front edge and a linear rear edge.

FIG. 8 illustrates a mop head 160, which may have a main body portion 161 made from relatively stiff material be made such as polypropylene and ear portions 162 made from a relatively more resilient material, such as santoprene. Mop head 160 has a generally trapezoidal shape with rounded corners and front flexible ears 162. The flexible ears 162 may each have a central cutout portion 163 that enhances the ability of the ears to flex and change shape when encountering an object. In some embodiments the maximum thickness of an ear portions in a unitary mop head is about 0.8 inches and the minimum thickness is about 0.3 inches. Unlike the mop heads shown in FIGS. 4-7, the rear/trailing edge 164 of the mop head 160 is a straight line that facilitates cleaning right up to the interface with linear surfaces, such as baseboards. The front/leading edge 166 has an arcuate shape, which, in combination with a similarly shaped mop pad (not shown) serves as a "debris catcher." The front edge 166 of the mop head and the corresponding shape of an associated mop pad (not shown in FIG. 8), because of the arcuate shape, tends to retain collected debris at the front of the mop head, even when changing the direction of forward movement. A linear edge, in contrast, would allow the collected debris to "spill out" at the lateral ends of the mop head 160 and associated mop pad.

It will be appreciated from the above discussion that a mop assembly may be provided with flexible ear portions that allow the lateral ends of an associated mop pad to resiliently flex when encountering a wall or other object. In some embodiments the resilient operation is enabled entirely by the structure of the mop pad. In other embodiments the resilient operation of the mop pad ear portions is enabled by co-operation of both structure of the mop pad and structure of the mop head.

Figure 9:
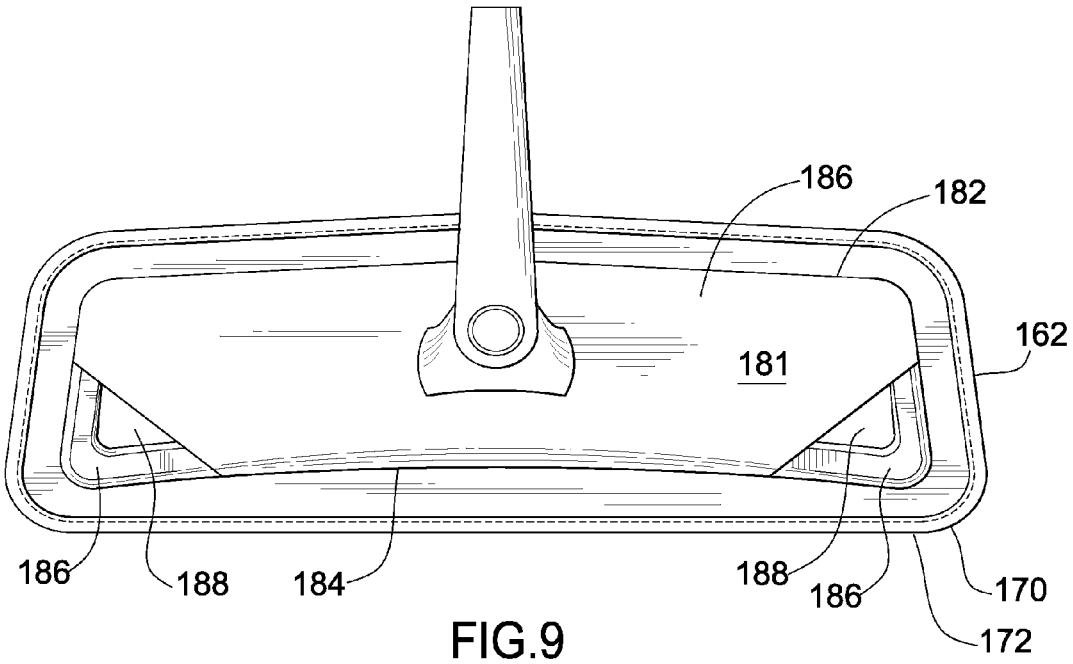
FIG. 9 is a top plan view of another mop assembly.

FIG. 9 is a top plan view of another mop head 180 having a relatively rigid main body portion 181 and flexible ear portions 186. The flexible ear portions may have central holes 188 therein. The mop head 180 may have an arcuate rear edge portion 182 and an arcuate front edge portion 184, which may be substantially concentric. The mop pad 170 may have a generally rectangular or slightly trapezoidal shape.

Figure 10:
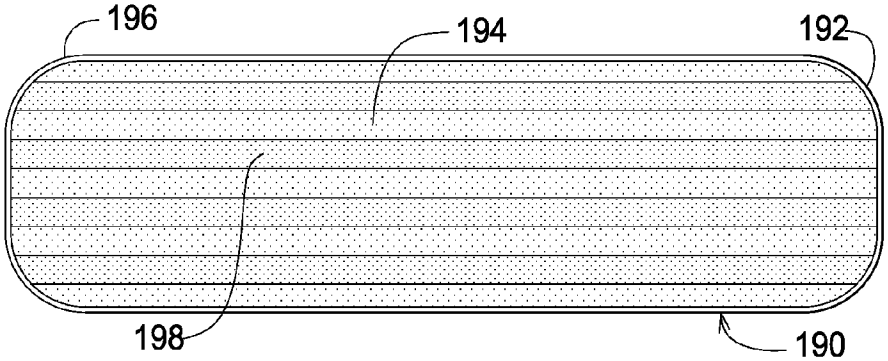
FIG. 10 is a bottom plan view of a floor mop pad.
Figure 11:
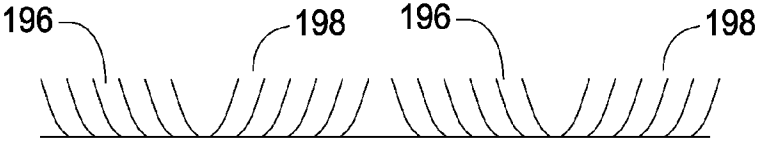
FIG. 11 is a schematic cross-sectional view of fabric strips of the floor mop pad of the type shown in FIG. 10.

FIG. 10 is a bottom plan view of a mop pad 190, which may have the same general shape as the mop pad 170 shown in FIG. 9 or other shapes. The mop pad 190 has an outer peripheral edge portion 192 and an interior portion 194. The interior portion 194 comprises a plurality of alternating parallel strips 196 198. As shown schematically by FIG. 11, the strips 196 are constructed from a material having fibers which are inclined forwardly i.e. in the direction in which the mop is pushed. The strips 198 are constructed from material having fibers that are inclined rearwardly. Applicants have discovered that providing a mop with such strips 196 198 on the mop pad facilitates the cleaning action of the mop 190.

Figure 12:
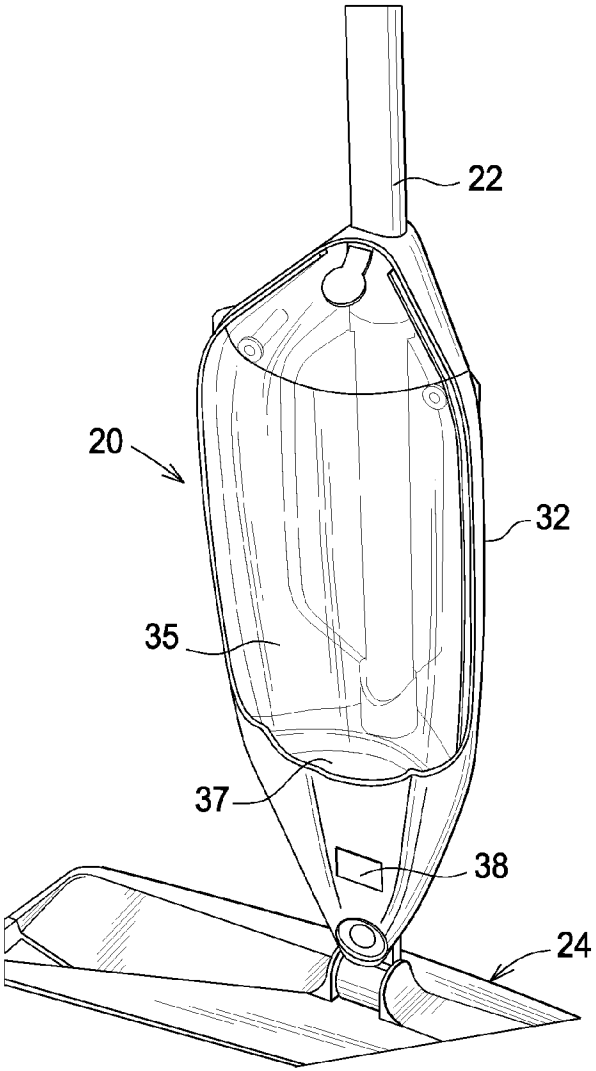
FIG. 12 is an isometric view of the mop of FIG. 2 with a front panel removed from an enclosure for a collapsible flexible bag reservoir.

FIG. 12 illustrates a portion of the mop assembly 20 of FIG. 2. The mop assembly 20, as previously indicated, has a housing assembly 32 that is adapted to receive a collapsible flexible bag reservoir, such as those illustrated in FIGS. 13-30. At the bottom of the housing assembly 32 is a coupling portion 37, which is adapted to engage an orifice portion of a collapsible flexible bag reservoir in sealed relationship therewith. This coupling portion 37 may comprise threads, a clamping assembly, gaskets, or other structure that is used to couple the collapsible flexible bag reservoir to the housing assembly 32. When thus coupled, the collapsible flexible bag reservoir discharges liquid therefrom into a liquid pumping assembly, which terminates in a spray nozzle 38. In one embodiment the pumping assembly is a mechanical assembly operated through deflection of a mechanical lever or trigger such as illustrated at 222 in FIGS. 13 and 14. In another embodiment the pumping assembly is an electrical pumping assembly, which may be actuated by a switch on the handle (not shown).

Figure 13:
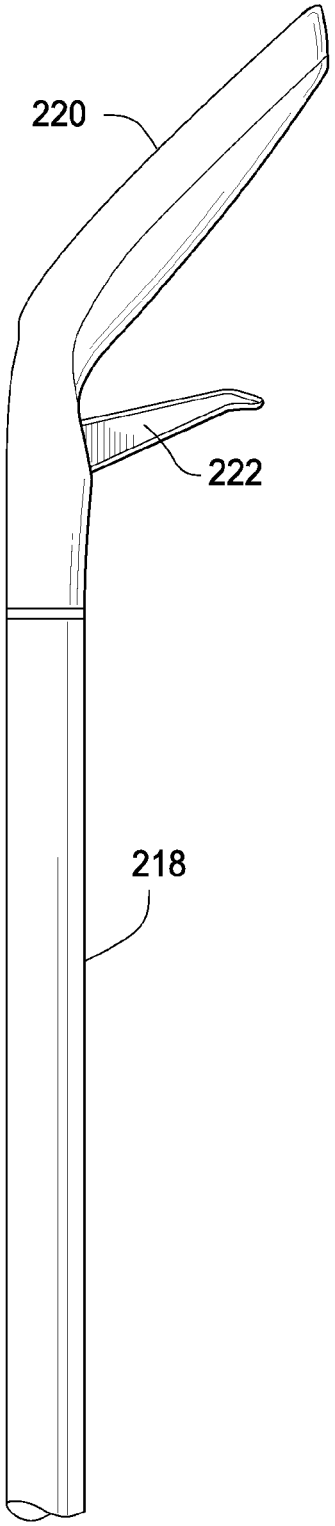
FIG. 13 is a side elevation view of a handle for a mop having a collapsible flexible bag reservoir.
Figure 14:
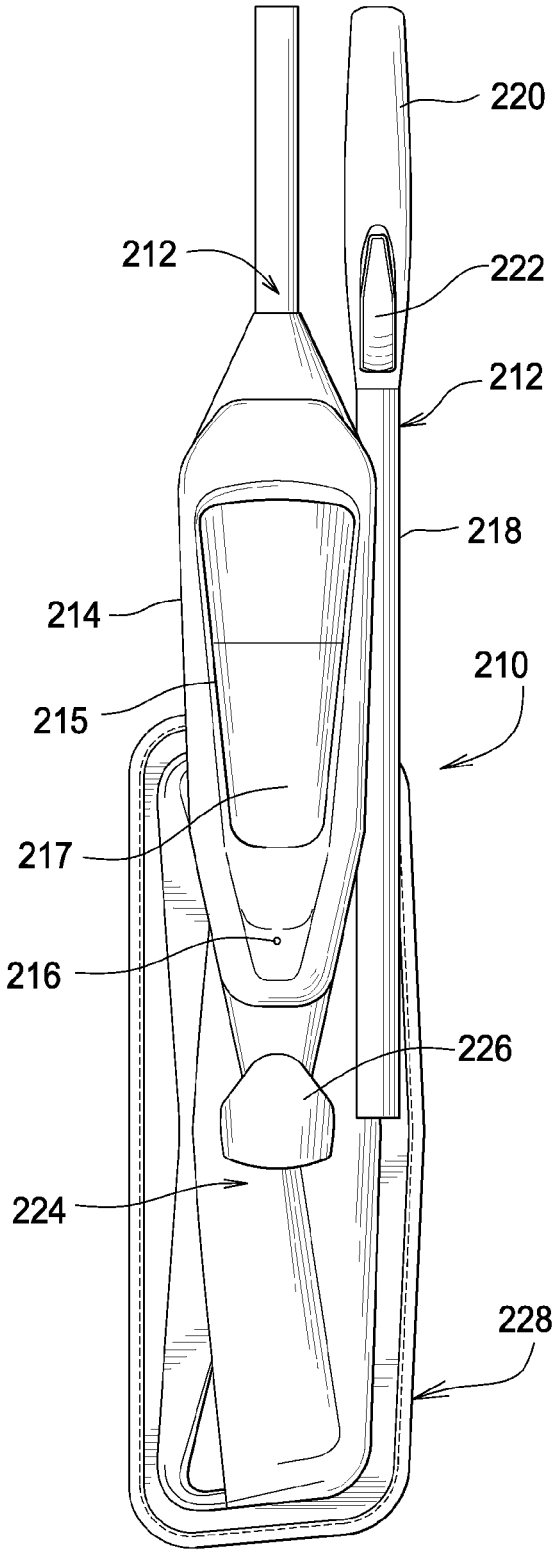
FIG. 14 is a top plan view of a disassembled mop having a collapsible flexible bag reservoir.
Figure 15:
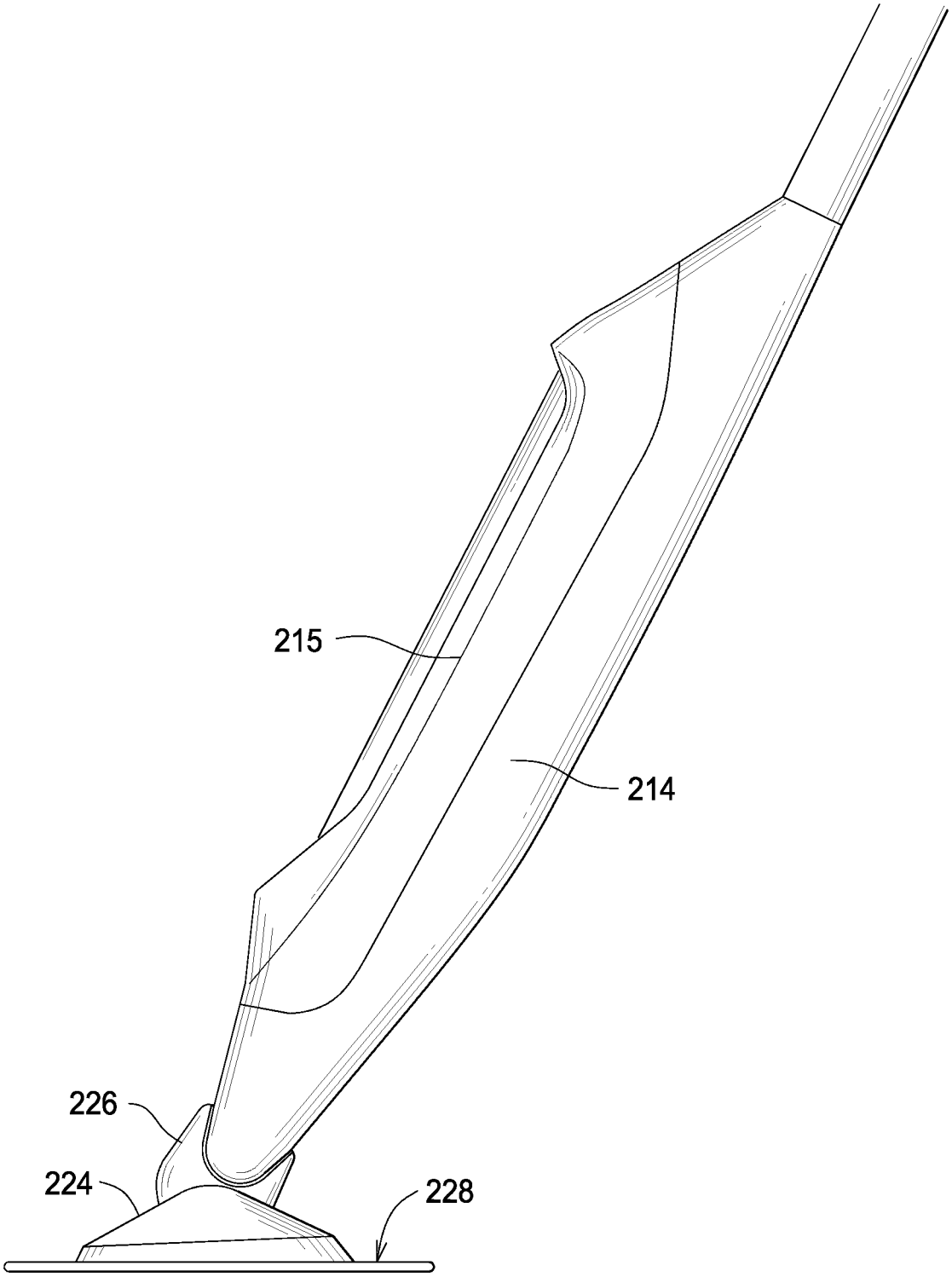
FIG. 15 is a side elevation view of the mop of FIGS. 13 and 14.

FIGS. 13-15 illustrate another embodiment of a mop assembly 210 having a collapsible flexible bag reservoir therein. This mop assembly 210 comprises a segmented handle assembly 212. The handle assembly 212 includes a first, bulbous, handle portion 214 that is adapted to receive a flexible reservoir 217 supported therein. This bulbous handle portion 214 has a cover plate 215 it may be removed or pivoted away from the remainder of the handle portion to allow insertion of a collapsible flexible bag reservoir.

The handle assembly includes a second handle portion 218 that includes a handgrip 220 with a deflectable trigger 222 at one end thereof. Squeezing the trigger 222 causes liquid from the collapsible flexible bag reservoir to be discharged from spray nozzle 216. As liquid is emptied from the collapsible flexible bag reservoir it collapses within the first handle portion 214. Such collapse occurs because the collapsible flexible bag reservoir is very thin walled and flexible, unlike most containers such as plastic bottles and the like.

Mop assembly 210 may also include a mop head 224, which is attached by a pivot assembly 226 to the handle assembly 212. A mop pad 228 may be attached to the bottom of the mop head 224.

Figure 16:
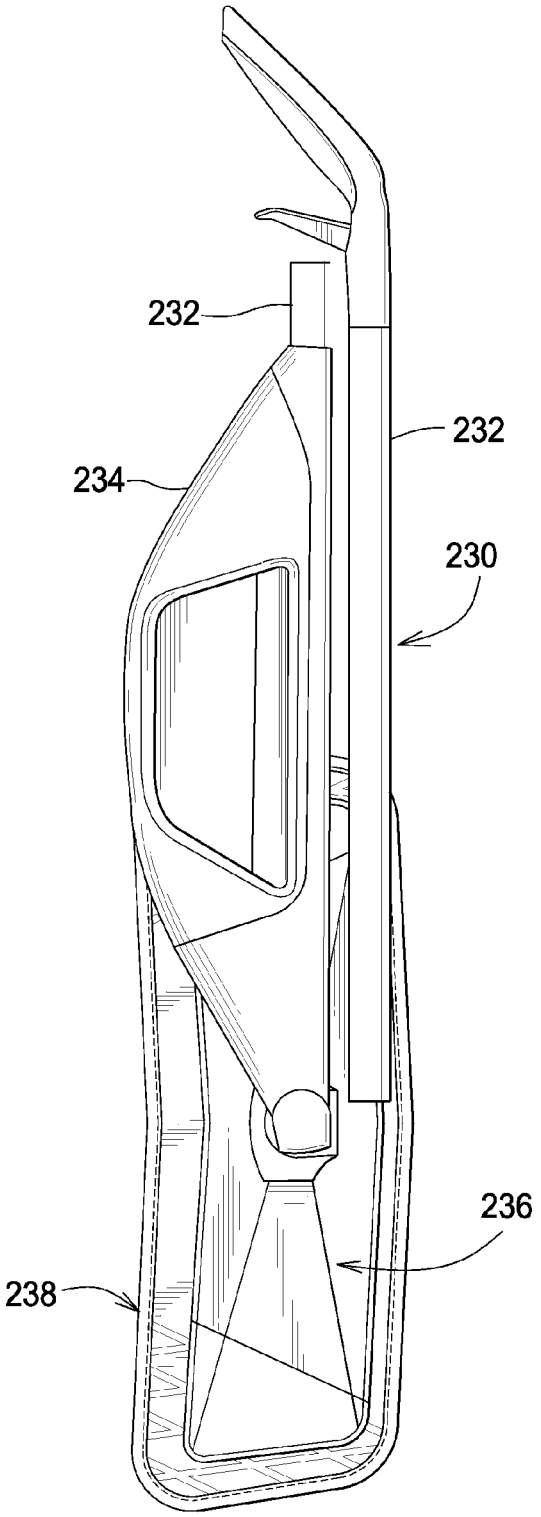
FIG. 16 is a top plan view of another embodiment of a mop having a collapsible flexible bag reservoir, shown in a disassembled state.

Another mop assembly 230 is illustrated in FIG. 16. This mop assembly 230 may comprise a segmented handle assembly 232, which includes a bulbous handle portion 234 that is adapted for receiving a collapsible flexible reservoir therein. The bulbous handle portion 244 differs from the handle portion 214 shown in FIGS. 14 and 15 in shape. The handle portion 244 is less wide and extends farther in a forward direction than handle portion 214. The mop assembly 230 may also include a mop head 236 and a mop pad 238.

Figure 17:
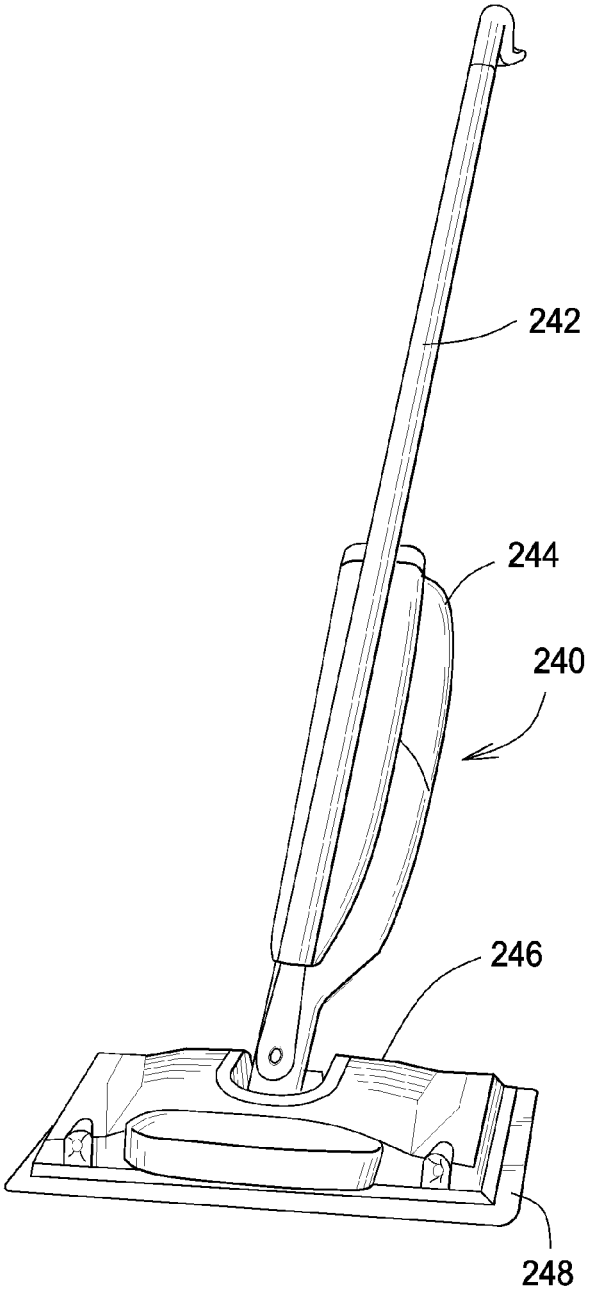
FIG. 17 is a front isometric view of another embodiment of the mob having a collapsible flexible bag reservoir.
Figure 18:
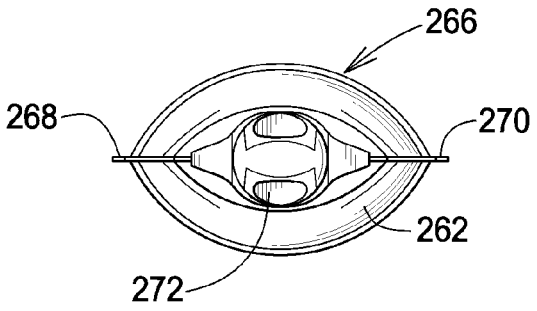
FIG. 18 is a top plan view of one embodiment of a multiple use collapsible flexible bag reservoir.
Figure 21:
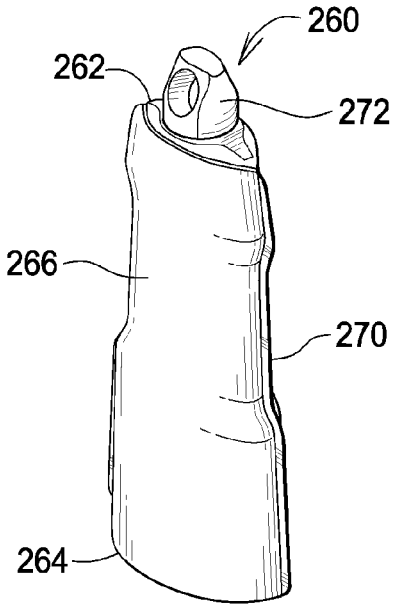
FIG. 21 is an isometric view of the collapsible flexible bag reservoir of FIGS. 18-20.
Figure 19:
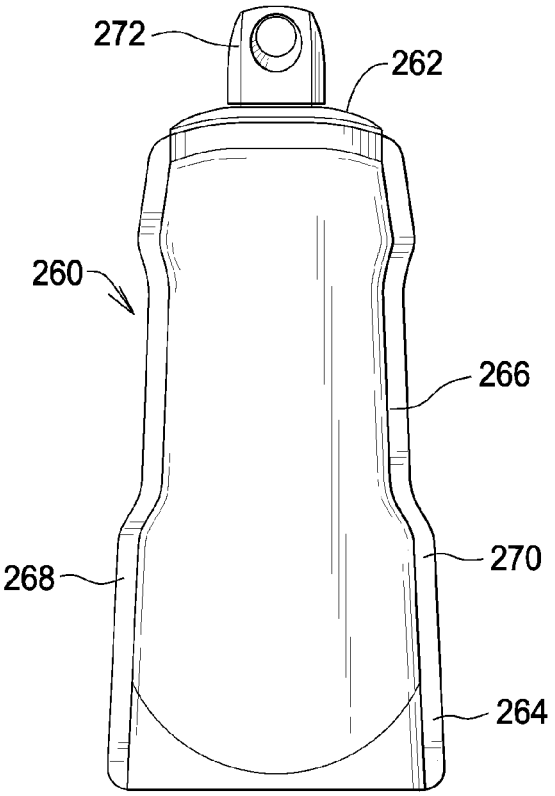
FIG. 19 is a side elevation view of the collapsible flexible bag reservoir of FIG. 18.
Figure 20:
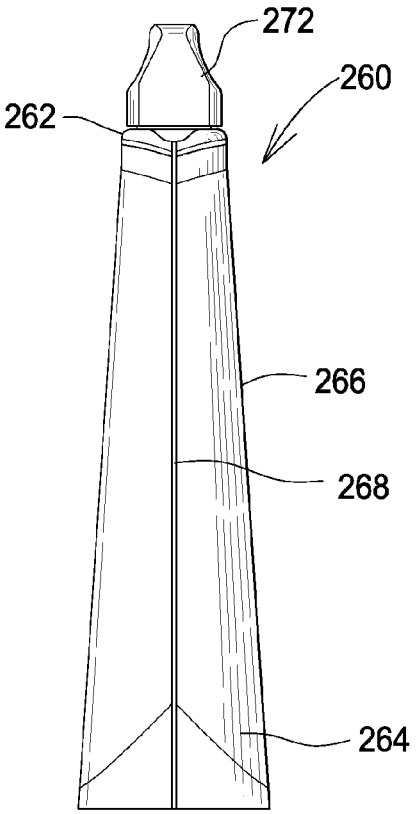
FIG. 20 is an end elevation view of the collapsible flexible bag reservoir of FIGS. 18 and 19.
Figure 22:
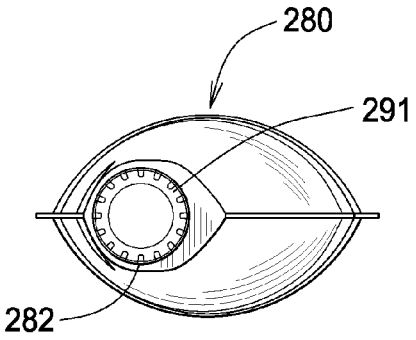
FIG. 22 is a top plan view of another embodiment of a collapsible flexible bag reservoir.
Figure 25:
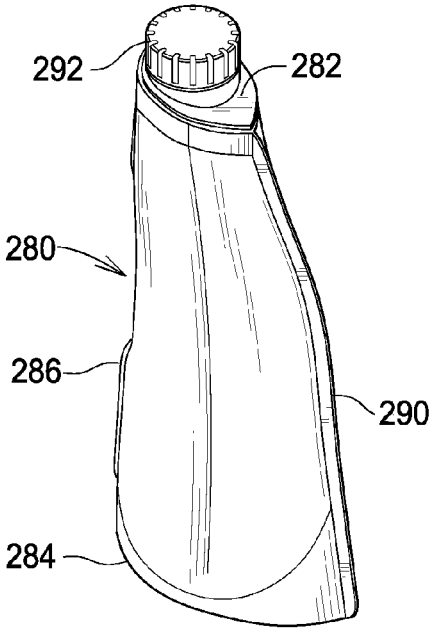
FIG. 25 is an isometric view of the collapsible flexible bag reservoir of FIGS. 22-24.
Figure 23:
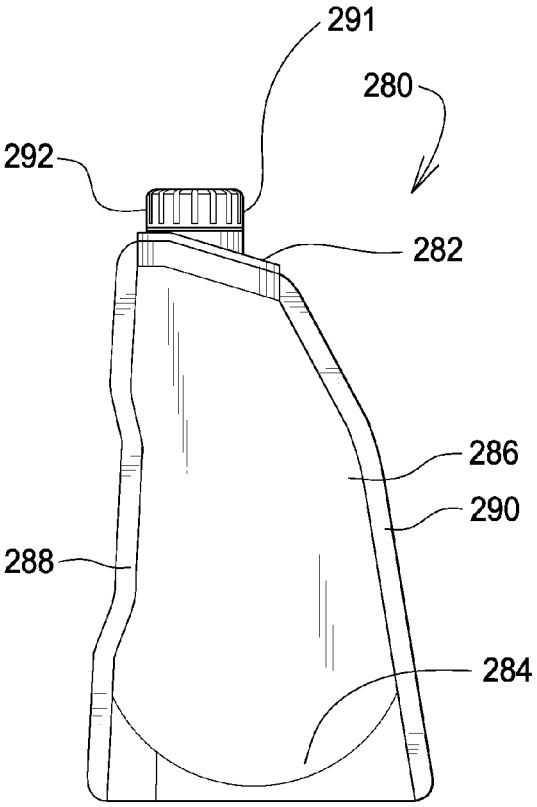
FIG. 23 is a side elevation view of the collapsible flexible bag reservoir of FIG. 22.
Figure 24:
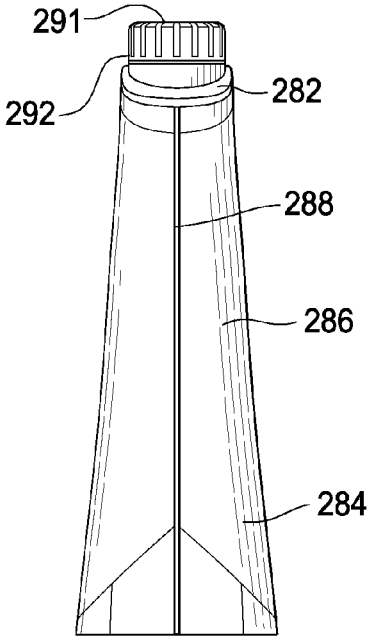
FIG. 24 is an end elevation view of the collapsible flexible bag reservoir of FIGS. 22 and 23.

Another mop assembly 240 is illustrated in FIG. 17. This mop assembly 240 also includes a collapsible flexible bag reservoir receiving bulbous handle portion 244. The bulbous handle portion 244 extends rearwardly from the mop handle 242 in this embodiment. Mop assembly 240 may also comprise a mop head 246 having a mop pad 248 removably attached thereto.

FIGS. 18-21 illustrate a first embodiment of a collapsible flexible bag reservoir 260. Bag reservoir 260 has a top portion 262 a bottom portion 264 and a middle portion 266, which may be formed from sheets of flexible plastic material that are seamed together at opposite lateral side portions 268, 270 thereof. A closure member 272 may be threaded into an orifice member (not visible) with matching threads. This collapsible flexible bag reservoir 260 may be used in a mop assembly such as illustrated at 20, 210, 230, and 240 herein. It may also be used as a separate liquid dispensing container with a spray nozzle or other liquid dispensing head attachment provided thereon. In some embodiments liquid may be poured onto an applicator cloth or a surface to be treated, directly from a recloseable opening such as a threaded spout that is adapted to receive a screw-on cap.

FIGS. 22-25 illustrate a second collapsible flexible bag reservoir 280 constructed from flexible plastic sheets, similar to collapsible flexible bag reservoir 260. Collapsible flexible bag reservoir 280 includes a top portion 282, a bottom portion 284, and a middle portion 286. Plastic sheets forming the bag 260 are seamed together at lateral seams 288 and 290. A screw on threaded cap 292 may be used to close a threaded orifice 291 (hidden threads of orifice shown in dashed lines) protruding from the top portion 282.

Figure 26:
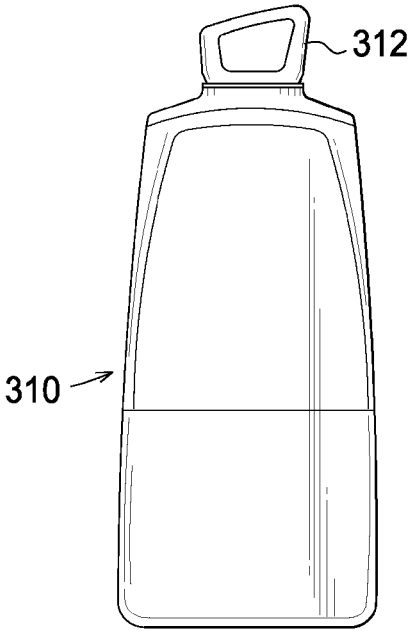
FIG. 26 is a side elevation view of another embodiment of collapsible flexible bag reservoir.
Figure 27:
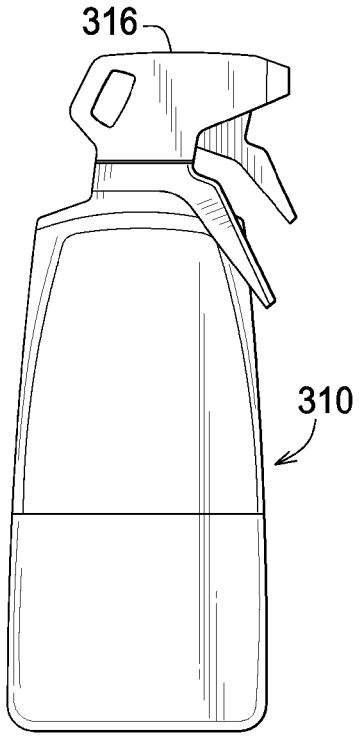
FIG. 27 is a side elevation view of the collapsible flexible bag reservoir of FIG. 26 with a hand spray assembly mounted thereon.

FIG. 26 illustrates a collapsible flexible bag reservoir 310 formed from flexible plastic sheets, which may be similar in construction to collapsible flexible bag reservoir 260, and 280. FIG. 27 illustrates a collapsible flexible bag reservoir 310 provided with a spray head assembly 316.

Figure 28:
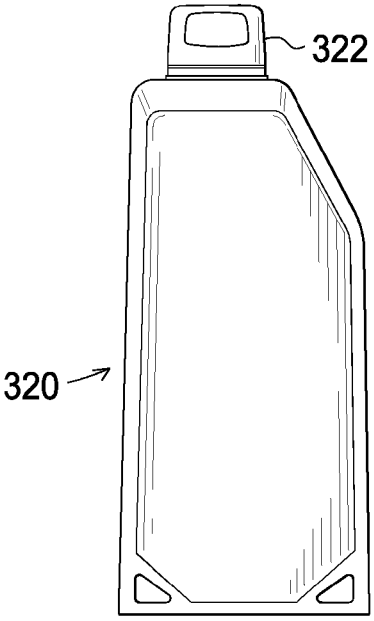
FIG. 28 is a side elevation view of another embodiment of a collapsible flexible bag reservoir.
Figure 29:
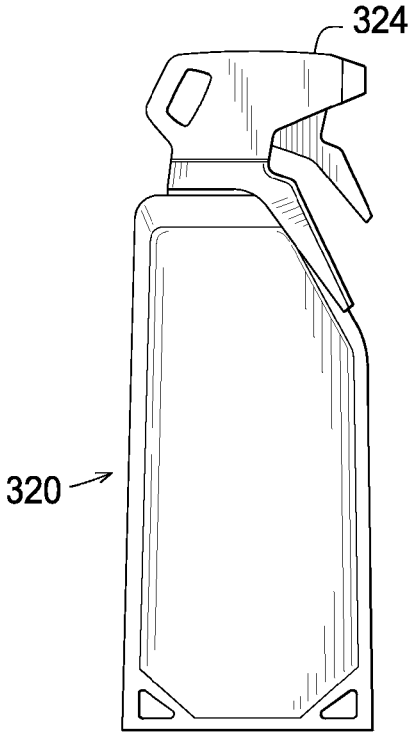
FIG. 29 is a side elevation view of the collapsible flexible bag reservoir of FIG. 28 with the hand spray assembly mounted thereon.

FIGS. 28 and 29 illustrate another collapsible flexible bag reservoir 320 that may have a threaded closure member 322. Threaded closure member 322 may be replaced by a hand actuated spray pump assembly 324.

Figure 30:
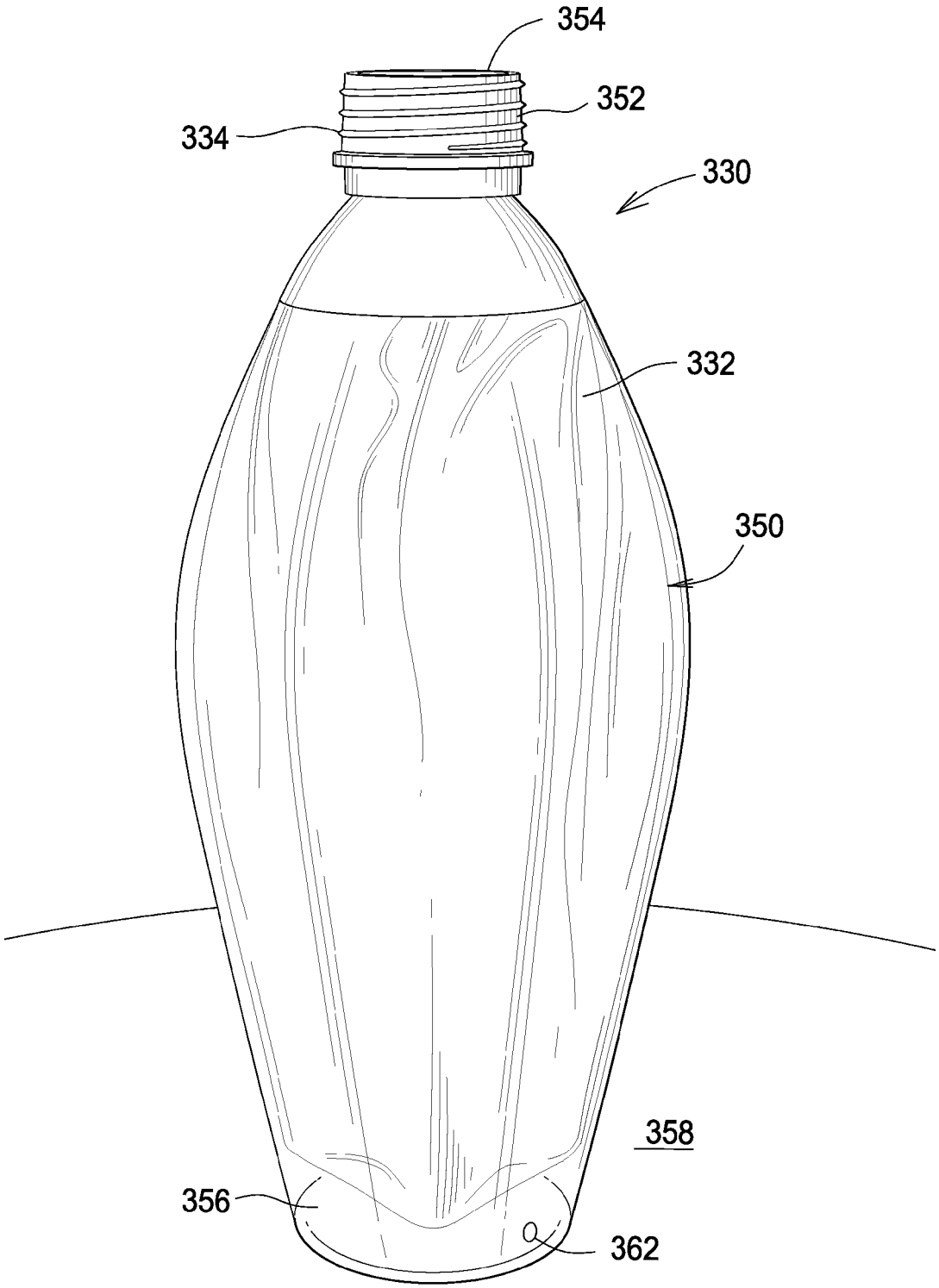
FIG. 30 is an isometric view of a collapsible flexible bag reservoir supported in a bottle enclosure.

FIG. 30 illustrates a bag and bottle enclosure assembly 330. A bottle 350, which may be a plastic bottle, has an upper end portion 352, which terminates in an upper end opening 352. A lower end or base portion 356 is adapted to support the bottle 350 in an upright position when placed on a flat horizontal surface 358. A collapsible flexible bag 332 with an open upper end portion 334 is supported within the bottle 350. The upper open end portion 334 of the bag is attached to the bottle at the upper end portion 352 of the bottle 350. Thus, liquid poured into the bottle open end portion 352 also passes through bag open end portion 334 and into the collapsible flexible bag 332. The upper end portion 352 of the bottle 350 may comprise threads or other structure to facilitate coupling of the bottle opening 352 to an interior reservoir and/or pump assembly of a floor mop, e.g. floor mop 20, shown in FIGS. 2 and 12. At least one vent hole 362 is provided at the lower end portion 356 of the bottle 350 allowing air to enter the bottle 350 as the contents of the plastic bag 330 is dispensed.

It will be appreciated from the foregoing that various embodiments of a collapsible flexible bag reservoir for a mop that are disclosed herein may be constructed as free standing liquid containers, which may be used as part of or independently from an associated mop assembly. In other words, in one mode of use, such collapsible flexible bag reservoirs operate as liquid reservoirs for spray mops of various configurations and, in another mode of use, such collapsible flexible bag reservoirs operate like traditional spray bottles. Various types of liquids including cleaning liquids, polishes and other liquids may be dispensed.

Certain specific embodiments of collapsible flexible bag reservoirs and associated mops have been expressly described herein. Various alternative embodiments of such collapsible flexible bag reservoirs and associated mops and methods of use will occur to those skilled in the art after reading this disclosure. It is intended for the language of the appended claims to be broadly construed to cover such alternative embodiments, except as limited by the prior art.

What is claimed is:

1. A cleaning assembly comprising:

a mop handle;

a mop head mountable on said mop handle;

a spray head mounted on at least one of said mop handle and mop head;

a collapsible flexible bag reservoir filled with floor treating liquid that is removably mountable on said mop handle and supported within an enclosure; and a liquid pump assembly adapted to pump said liquid from said collapsible flexible bag reservoir to said spray head.

2. The cleaning assembly of claim 1 wherein said enclosure is a plastic enclosure.

3. The cleaning assembly of claim 1 wherein said mop head comprises an inwardly concave front edge and a linear rear edge and flexible ear portions on opposite lateral sides of said front edge.

4. The cleaning assembly of claim 1 wherein said spray head is mounted on said mop handle.

5. The cleaning assembly of claim 1 further comprising a mop pad with a stiffening ring attachable to said mop head.

6. The cleaning assembly of claim 1 wherein said liquid pump assembly comprises a coupling portion adapted to receive an orifice portion of said collapsible flexible bag reservoir in sealing liquid communication therewith.

* * * * *